US006364157B1

(12) United States Patent
Tosspon

(10) Patent No.: US 6,364,157 B1
(45) Date of Patent: Apr. 2, 2002

(54) SHOTSHELL STORAGE DEVICE AND DISPENSER, ESPECIALLY SUITABLE FOR WATERFOWL BLINDS

(76) Inventor: George E. Tosspon, 583 Loop Rd., Jonesville, LA (US) 71343

( * ) Notice: Subject to any disclaimer, the term of this patent is extended or adjusted under 35 U.S.C. 154(b) by 0 days.

(21) Appl. No.: 09/589,558

(22) Filed: Jun. 7, 2000

(51) Int. Cl.[7] ..... B65H 3/00

(52) U.S. Cl. ..... 221/191; 221/283; 221/303; 221/312 C

(58) Field of Search ..... 221/191, 193, 221/194, 197, 281, 283, 287, 303, 312 R, 312 C; 312/45, 72, 75; 211/59.2

(56) References Cited

U.S. PATENT DOCUMENTS

| | | | | | |
|---|---|---|---|---|---|
| 1,753,957 | A | * | 4/1930 | Washburn | 221/287 X |
| 2,597,940 | A | * | 5/1952 | Locke | 221/197 X |
| 2,680,663 | A | * | 6/1954 | Geller | 221/191 |
| 4,194,657 | A | | 3/1980 | Thor | |
| 4,381,845 | A | | 5/1983 | Feis | |
| 4,651,619 | A | | 3/1987 | Voecks | |
| 5,111,964 | A | | 5/1992 | Couper | |
| 5,361,937 | A | * | 11/1994 | Wiese | 221/281 X |
| 5,390,821 | A | | 2/1995 | Markel | |
| 5,700,075 | A | * | 12/1997 | Perone | 312/35 |

* cited by examiner

*Primary Examiner*—David H. Bollinger
(74) *Attorney, Agent, or Firm*—Jease D. Lambert

(57) ABSTRACT

Apparatus for convenient and secure storage of firearm ammunition, especially shotshells, while permitting quick access to the shells for loading of the gun. In one preferred embodiment, the apparatus comprises a main storage compartment, capable of holding a full box of shotgun shells, having an extended shell loading tray. A removable snap fit lid fits atop the main storage compartment, and projecting lips on the rear wall of the main storage compartment fit into a channel on an accompanying base. The base may be mounted on a structure, for example the wall of a hunting blind. To use the apparatus, the main storage compartment can then be removed, inverted over a full box of shotgun shells, then turned over again together with the box of shells. Next, the main storage compartment can be slid into the base, then the box removed, which drops the shotgun shells into the main storage compartment. From the main storage compartment, the shotgun shells gravity feed onto the shell loading tray, where they may be easily extracted for loading into the shotgun. The lid on the main storage compartment protects the majority of the shells from rain, snow and other inclement weather.

14 Claims, 6 Drawing Sheets

SHOTSHELL STORAGE DEVICE AND DISPENSER, ESPECIALLY SUITABLE FOR WATERFOWL BLINDS

BACKGROUND—FIELD OF THE INVENTION

This invention relates to apparatus used as accessories in the shooting sports. With more particularity, this invention relates to an apparatus for short term storage and ready dispensing of firearm ammunition, particularly ammunition for shotguns (sometimes referred to in this patent application as "shotshells"), when the shooter is in close proximity to a structure, such as a hunting blind.

BACKGROUND—DESCRIPTION OF THE RELATED ART

The various types of shooting sports, whether for handguns, rifles, or shotguns, require ready access to ammunition. Ammunition comes from the manufacturer usually packaged in paper or hard plastic containers which, while well suited for shipping and long term storage of the ammunition, are often not very efficient for quick access to shells, while on the shooting range or in the field. Additionally, paper containers break down when wet by rain or snow, and can cause a loss of ammunition.

Although the present invention is adaptable to provide easy dispensing of almost any type of ammunition, whether for handgun, rifle, or shotgun, in a number of situations, the apparatus is particularly suited to dispensing of shotshells to a hunter (who, usually by state and/or federal law, must use a shotgun to hunt feathered game) while stationed in a hunting "blind", which usually comprises an enclosure of some sort designed to hide the hunter from approaching winged prey. In particular, waterfowl, including ducks and geese, are often hunted from a blind which includes a structure or framework of lumber, metal, fiberglass, or other materials. As such, a convenient and strong mounting place for the present invention is usually readily accessible. If the shooting is good on a particular hunt, the hunter may have need to rapidly reload his or her shotgun a number of times during the course of the hunt.

Shotgun shells usually come packaged from the factory in boxes (usually made of cardboard) containing 25 shotshells, with a top flap for a lid. While, as mentioned above, such container is well suited for shipping and long term storage, the conventional cardboard box has a number of disadvantages in a hunting blind situation. Shotshells may be fairly easily extracted from the box while the box is relatively full (and thus the level of shells is high in the box), but as the number of shells in the box decreases, it becomes increasingly difficult to reach far enough into the box to get more shells. It is desirable for the hunter to keep a box of shells in a convenient location within the blind to facilitate loading of the shotgun. Often, blinds will have a small shelf or ledge to rest an open box of shells on. However, especially when few shells remain in the box, getting shells out of the box can become cumbersome, and there always exists the possibility (which happens surprisingly often) of knocking the box of shotshells off the shelf, with the resultant spillage of shotshells onto the bottom of the blind. Often, there is standing water or mud in the blind, making retrieval of the shells difficult, and possibly causing problems with the quality of the shells (due to their getting wet). Yet another problem with open boxes of shells in a blind is that the shells are exposed to rain, and as waterfowl hunts are often made in inclement weather this is a common occurrence. Further still, as mentioned above, paper boxes rapidly deteriorate in rainy and wet weather.

It is desirable, therefore, to have an apparatus which:

- is adapted to removably mount onto a structure, for example the interior of a blind;
- holds a fairly large quantity of shotshells (e.g., a full box of 25 shotshells);
- permits easy filling of the apparatus with shotshells;
- maintains the shotshells protected from the elements and securely held; while
- permitting ready access to the shotshells for quick reloading of the shotgun.

The known related art apparatus do not accomplish these tasks.

DESCRIPTION OF THE PREFERRED EMBODIMENT

The present invention lends itself to be used with a number of different types of ammunition and in a number of different physical settings. However, by way of example only and without limitation, the invention is described herein as used for the storage and dispensing of shotshells to be used in a shotgun, and more particularly still in a hunting blind situation where the apparatus may be removably mounted on a structure, such as a wall or post comprising part of the blind.

It is further noted that the shotshell dispenser of the present invention may be made in different sizes, and as such used for all of the common shotshell gauges, although it is recognized that 12 gauge shells will most likely be the most common application. However, depending upon the exact dimensions selected, the apparatus may be used for the .410 bore, and 28, 20, 16, 12, and 10 gauge shotguns (in addition to, as mentioned above, pistol or rifle ammunition).

Figure 1:
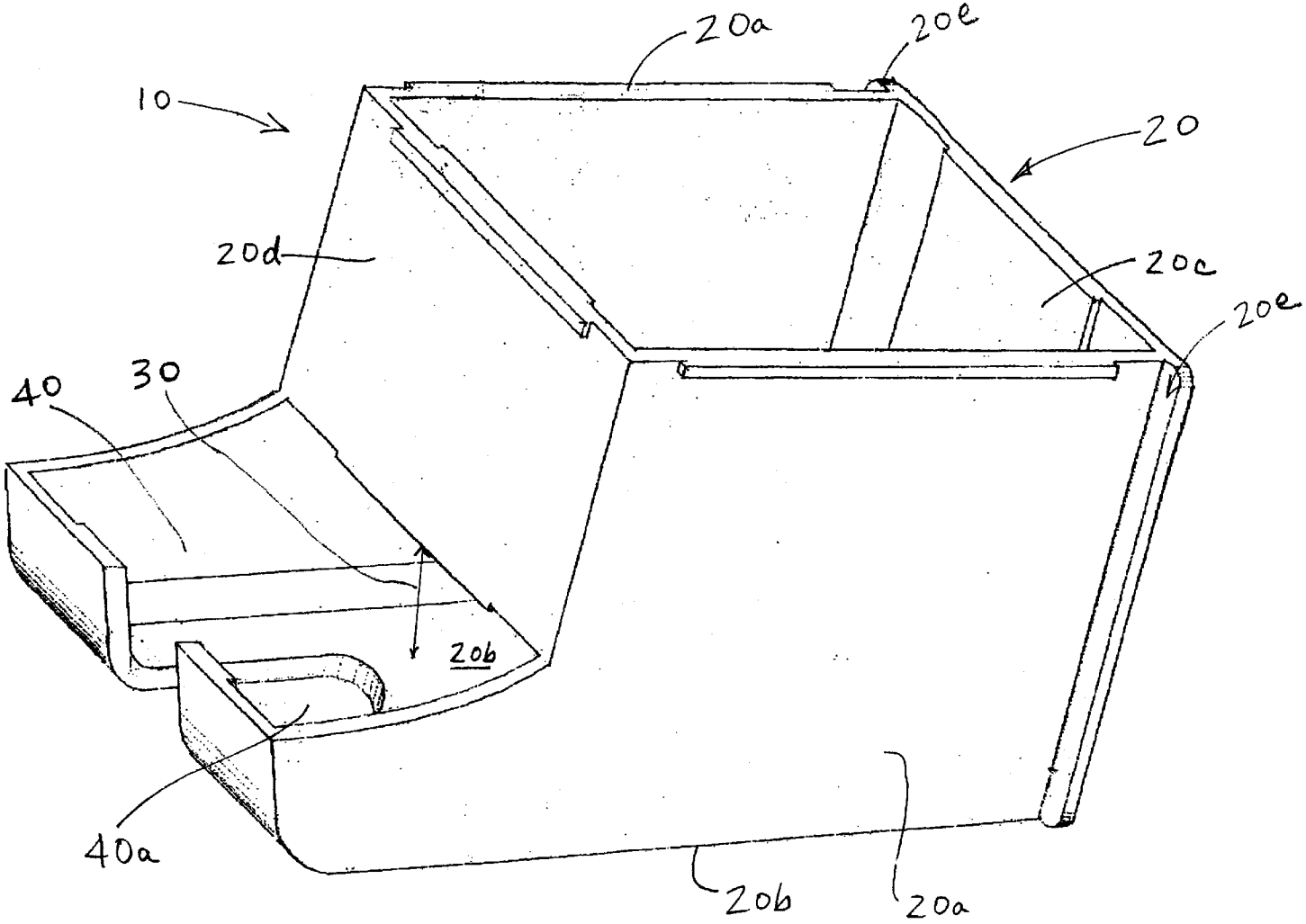
FIG. 1 is a perspective view of the shotshell storage and dispensing device of the present invention.

As seen in FIG. 1, the apparatus 10 comprises a main storage compartment 20 having sides 20*a*, a bottom 20*b*, and a rear face 20*c*. A front face 20*d* terminates a suitable distance above bottom 20*b*, leaving a shell feeding opening 30. Sides 20*a* and bottom 20*b* extend outwardly from front face 20*d*, forming a shell feeder tray 40. Preferably, the bottom of shell feeder tray 40 has a cutout 40*a* to ease lifting of shells from the tray, for loading into a shotgun, as will be later described.

Figure 2:
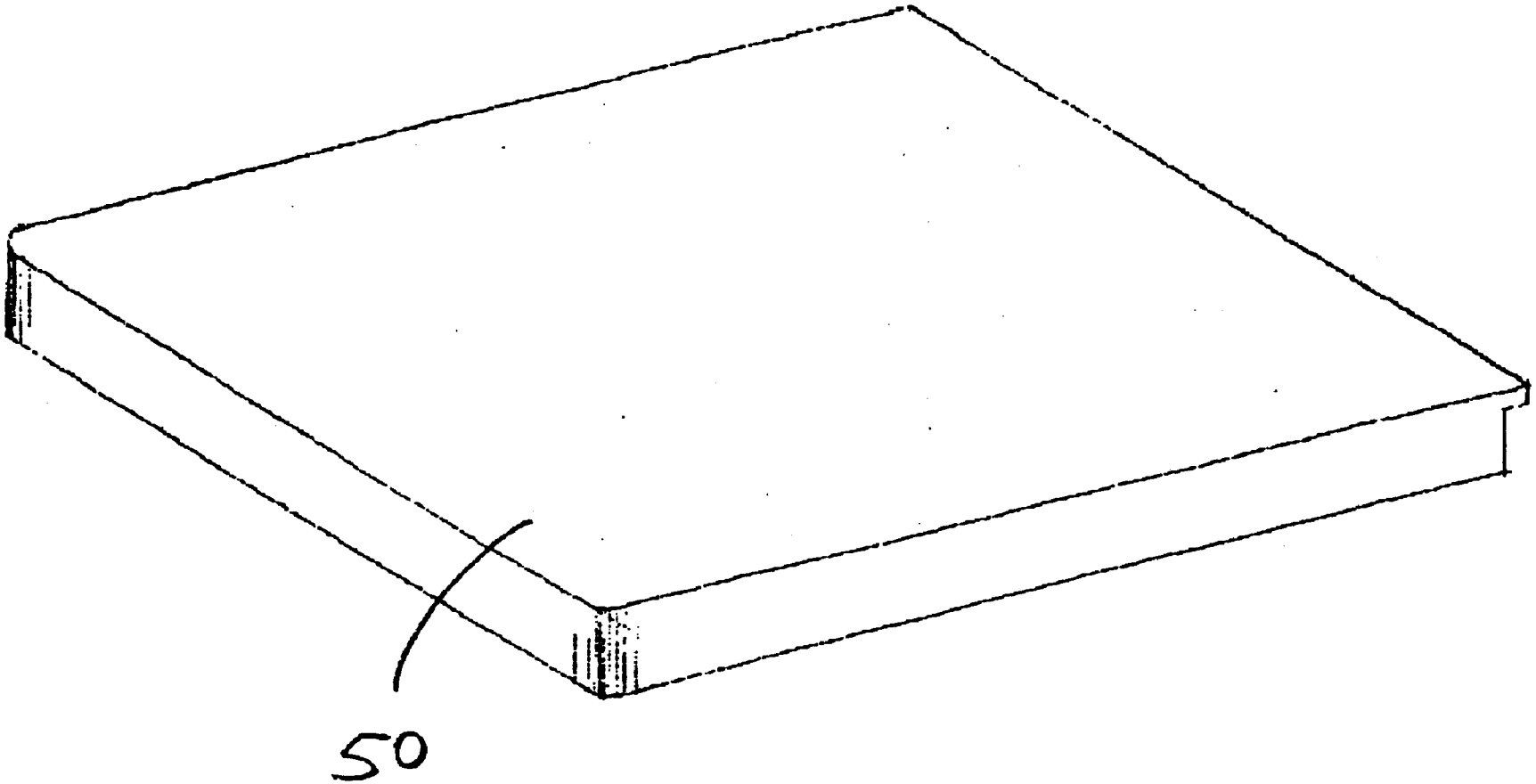
FIG. 2 is a perspective view of the lid of the invention.

Apparatus 10 further comprises a removable top 50, FIG. 2, which is preferably a snap fit onto the top of main storage compartment 20 and prevents rain, snow and other precipitation from entering main storage compartment 20.

Figure 3:
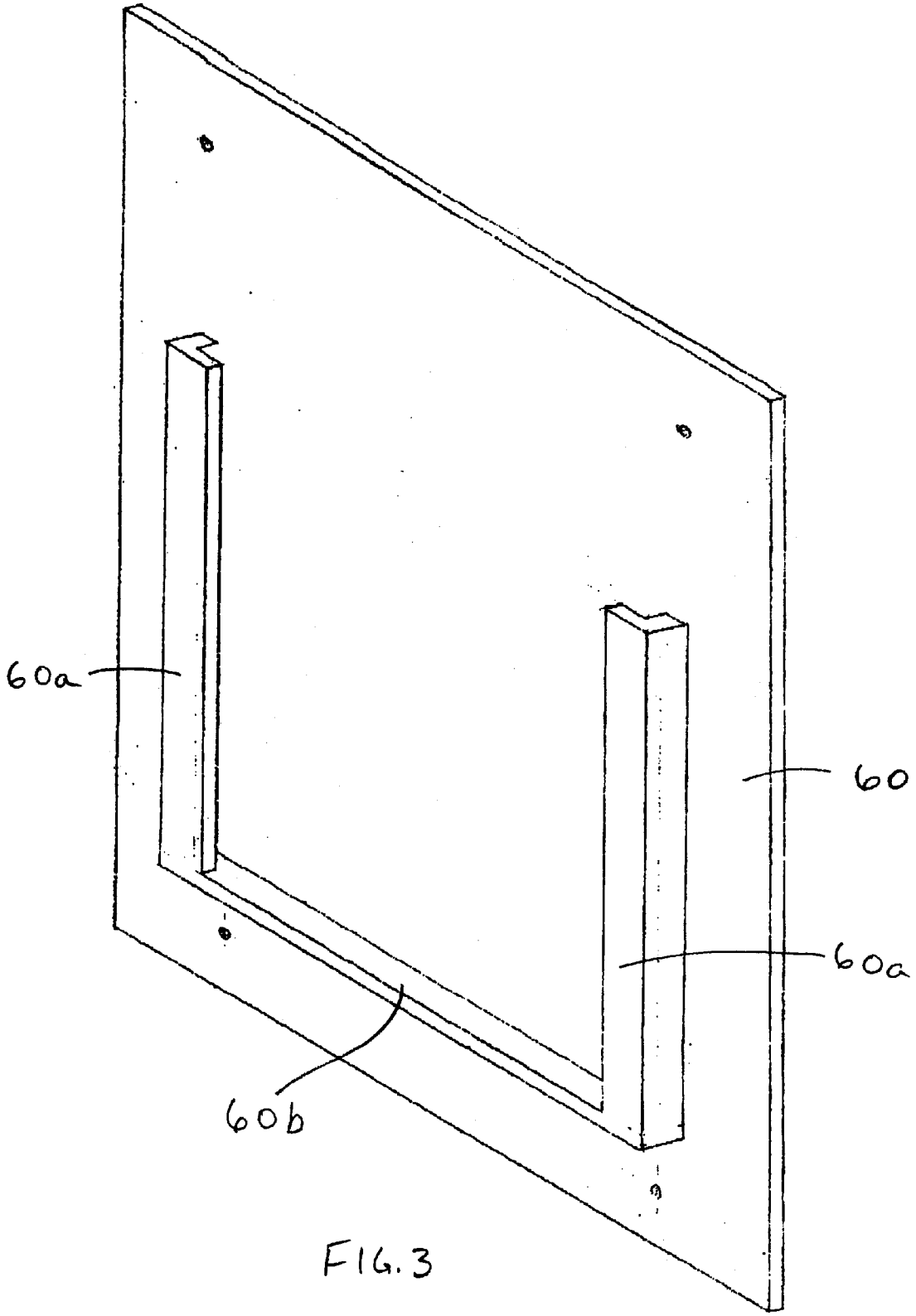
FIG. 3 is a perspective view of the base of the invention.
Figure 4:
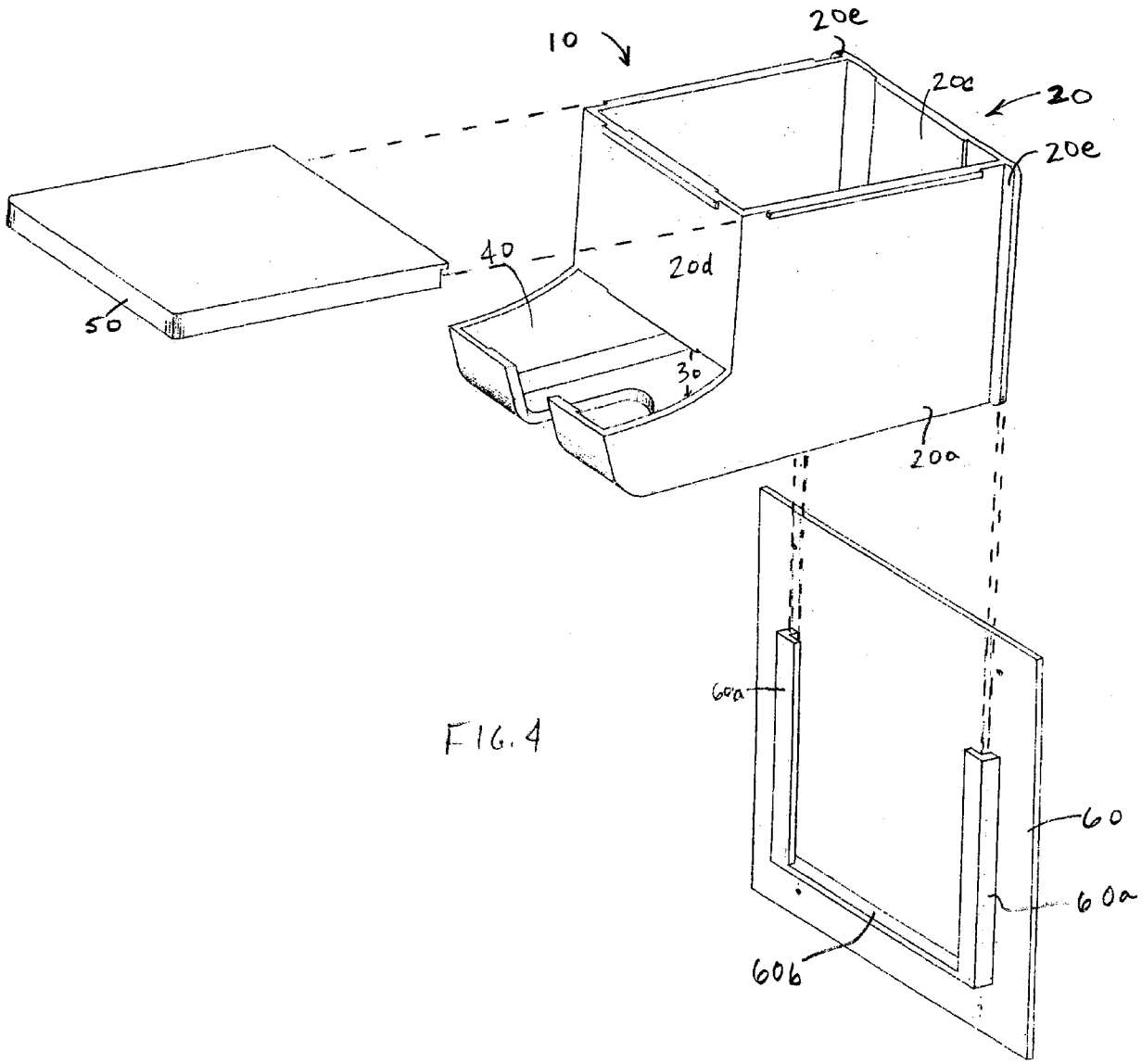
FIG. 4 is a perspective view of the various parts of the shotshell storage and dispensing device, with the lid aligned for placement atop the main storage compartment, and the main storage compartment positioned for mounting on the base.

In use, apparatus 10 is designed to be removably attached to a structure, for example the side or wall of a duck blind, or any other fixed wall, post or the like. In one embodiment, a base 60, as in FIG. 3, may be mounted onto the wall of a blind via screws, nails or the like. Base 60 has a pair of spaced apart tracks 60*a*, the tracks 60*a* having an "L" shaped cross section, thereby forming a slot, along with a bottom crosspiece 60*b* forming a stop. The sides of rear face 20*c* of main storage compartment 20 are extended outwardly beyond sides 20*a*, forming mounting lips 20*e*, to engage tracks 60*a*, so that main storage compartment 20 may be removably mounted to base 60 by sliding main storage compartment 20 into and out of tracks 60*a*. Bottom cross-piece 60*b* provides a positive stop to movement of main storage compartment 20 when inserted in base 60. FIG. 4 shows an exploded view of the different parts of the apparatus, including top 50 in position to snap onto main storage compartment 20, and main storage compartment 20 in position to slide into place on base 60 (mounting lips 20*e* engaging the slot formed by tracks 60*a* and base 60).

Figure 5:
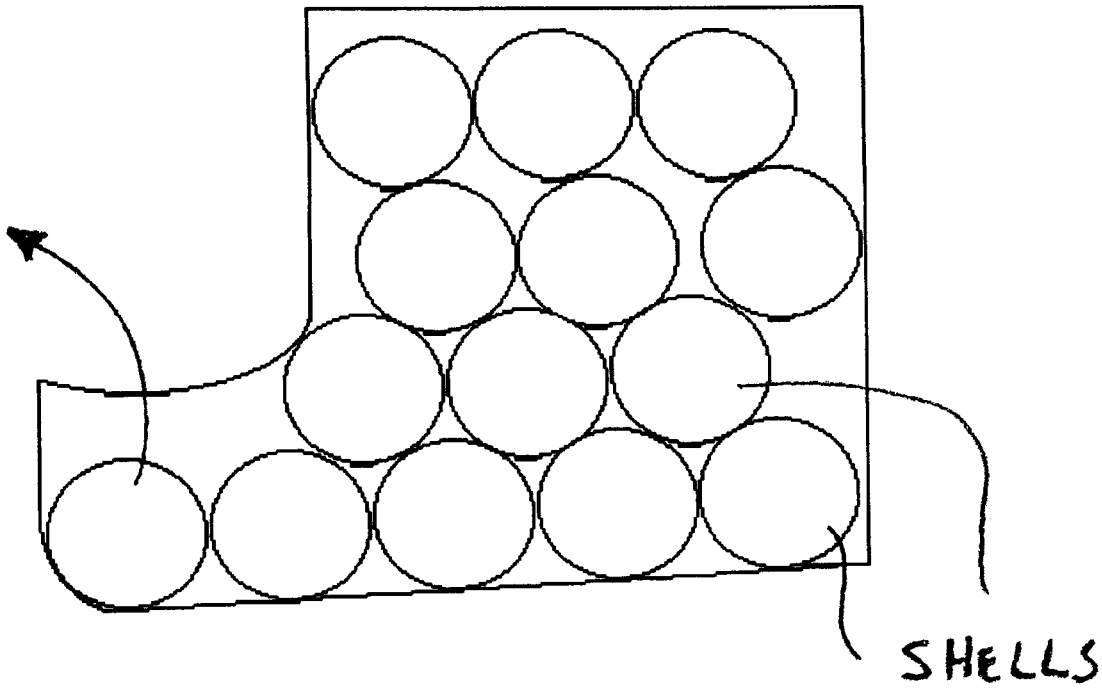
FIG. 5 is a view of the present invention in cross section showing an example of shotshells within the main storage container, and gravity fed onto the shell feeder tray for dispensing.

In use, main storage compartment 20 is removed from base 60. A box of shotgun shells is opened, and the flaps of the box folded back along the sides of the box. Main storage compartment 20 is inverted and lowered over the box of shotgun shells. Then, main storage compartment 20, together with the box of shotgun shells therein, is turned over, right side up. Preferably, main storage compartment 20 is then slid into base 60, and the shotgun shell box is then extracted, leaving the shotgun shells stacked within main storage compartment 20. The shotgun shells are gravity-fed through shell feeding opening 30, and thus several shells will roll out until stopped by the upturned end of shell feeder tray 40. FIG. 5 is a side view in cross section, showing position of the shells within the apparatus (FIG. 5 shows only an exemplary number of shells, and is not intended to show an entire box of 25 shells). Cutout 40*a* in shell feeder tray 40 permits the shells to be easily grasped for loading into a shotgun. In the preferred embodiment, when main storage compartment 20 is mounted on base 60, bottom 20*b* has a downward slope from the rear to the front, as seen in FIG. 5, to help ensure a gravity feeding of shotshells from main storage compartment 20 to shell feeder tray 40.

Figure 6:
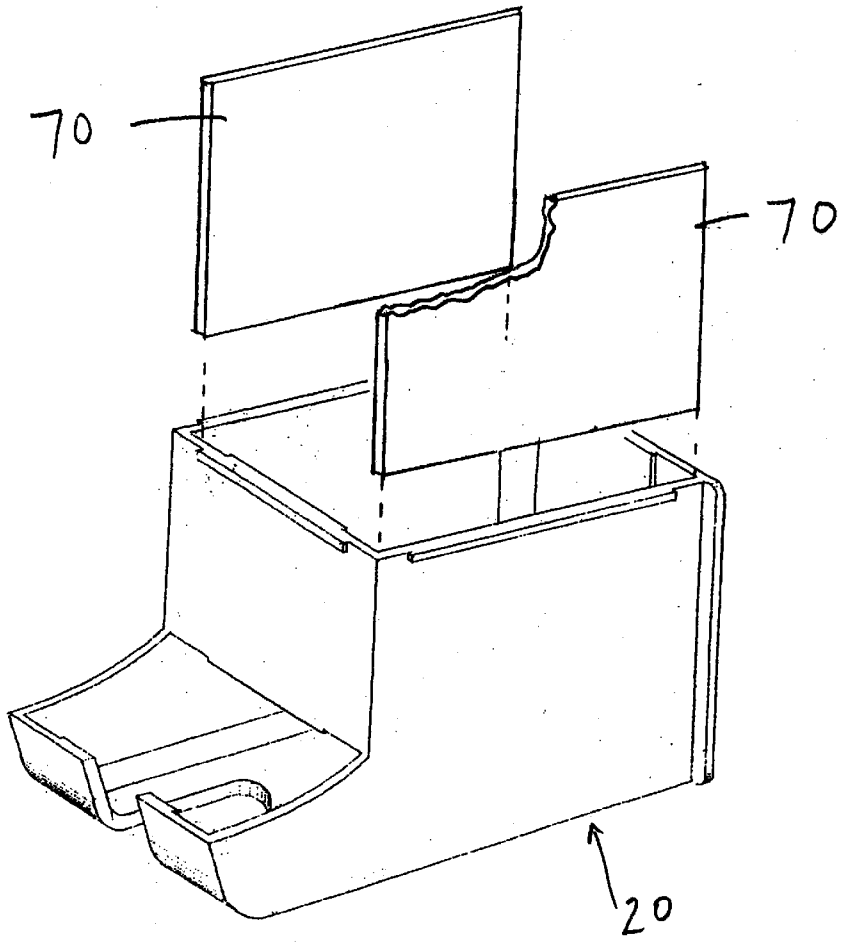
FIG. 6 shows another embodiment of the present invention.

As stated earlier, the dimensions of the apparatus may be adjusted to accommodate different gauges of shotgun shells, or different volumes of shells. The "standard" chamber length of shotguns is 2¾", and standard shotshells have a length which conforms to that chamber length. However, the present invention can accommodate longer shells, such as 3" and 3½" "magnum" shells. By way of example only, one of the presently preferred embodiments, for holding a full box (25 rounds) of 12 gauge shotshells, has interior dimensions of the main storage compartment of approximately 4⅝" measured from the interior of front face 20*d* to the interior of rear face 20*c*, approximately 3 7/16" measured between the interior surfaces of sides 20*a*, and a vertical depth of approximately 4". Shell feeding opening 30 may be approximately 1½". Those dimensions have proven to be effective for both 3" and 3½", 12 gauge shotshells, although it is understood that the dimensions set forth are exemplary only and are not limiting in any sense. In order to accommodate 2¾" shotshells in the same dimension main storage compartment, another embodiment of the present invention is shown in FIG. 6, which further comprises a pair of removable side plates 70 which slide vertically into main storage compartment 20 (one of the side plates 70 is shown in partial cross-section for clarity). The thickness of side plates 70 is such that relatively little end-to-end play remains with 2¾" shells in use.

The present invention may be made of a number of different materials. For relatively low cost, durability, and ease of working the material, plastic may be used, and the apparatus may be made by a molding process. Alternatively, sheet plastic may be used and the pieces joined by adhesives or fasteners such as screws. Sheet metal may be used, and the various parts joined by welding, brazing or the like, or fasteners such as screws. Wood may also be used as a fabrication material.

Thus the scope of the invention should be determined by the appended claims and their legal equivalents, rather than by the examples given.

I claim:

1. An apparatus for storage and dispensing of ammunition, comprising:

a) a main storage compartment comprising a bottom, sides, a rear face, and a front face, said front face terminating above said bottom and forming a shell feeding space between said bottom and a bottom edge of said front face, said sides and said bottom extending outwardly beyond said front face and forming a shell dispensing tray, said rear face further comprising lips extending outwardly past said sides;

b) a base adapted for mounting to a structure, said base comprising a pair of spaced apart tracks forming a slot and said base comprising a stop at a terminus of said tracks, said lips and said slot dimensioned so that said main storage compartment removably mounts on said base by said lips fitting into said slot; and c) a removable lid adapted to fit atop said main storage compartment.

2. The apparatus of claim 1, wherein said main storage compartment is dimensioned and configured to hold a full box of ammunition.

3. The apparatus of claim 2, further comprising a cut-out in a bottom surface of said shell dispensing tray.

4. The apparatus of claim 1, wherein said apparatus is formed from metal.

5. The apparatus of claim 1, wherein said apparatus is formed from plastic.

6. The apparatus of claim 1, wherein said apparatus is formed from metal.

7. The apparatus of claim 1, wherein said apparatus is formed from plastic.

8. The apparatus of claim 1, further comprising removable side panels disposed within and against said sides of said main storage compartment.

9. The apparatus of claim 1, wherein said bottom of said main storage compartment slopes downward from said rear face to said from face of said main storage compartment, when said main storage compartment is mounted on said base.

10. A shotshell storage and dispensing apparatus, comprising:

a) a main storage compartment comprising a bottom, sides, a rear face, and a front face, said front face terminating above said bottom and forming a shell feeding space between said bottom and a bottom edge of said front face, said shell feeding space sufficiently large to allow one shotshell at a time to pass therethrough, said sides and said bottom extending outwardly beyond said front face and forming a shell dispensing tray, said rear face further comprising lips extending outwardly past said sides;

b) a base adapted for mounting to a structure, said base comprising a pair of spaced apart tracks forming a slot and said base comprising a stop at a terminus of said tracks, said lips and said slot dimensioned so that said main storage compartment is removably mounted on said base by said lips fitting into said slot; and c) a removable lid adapted to fit atop said main storage compartment.

11. The apparatus of claims 10, wherein said main storage compartment is dimensioned and configured to hold at least 25 shotshells.

12. The apparatus of claim 11, wherein said apparatus is made of plastic.

13. The apparatus of claim 11, further comprising removable side panels disposed within and against said sides of said main storage compartment.

14. The apparatus of claim 10, wherein said bottom of said main storage compartment slopes downward from said rear face to said from face of said main storage compartment, when said main storage compartment is mounted on said base.

* * * * *